US012262820B2

(12) United States Patent
Cheng

(10) Patent No.: US 12,262,820 B2
(45) **Date of Patent: *Apr. 1, 2025**

(54) FOLDABLE SWING FRAME

(71) Applicant: WONDERLAND SWITZERLAND AG, Steinhausen (CH)

(72) Inventor: Manqun Cheng, Guangdong (CN)

(73) Assignee: WONDERLAND SWITZERLAND AG, Steinhausen (CH)

( * ) Notice: Subject to any disclaimer, the term of this patent is extended or adjusted under 35 U.S.C. 154(b) by 0 days.

This patent is subject to a terminal disclaimer.

(21) Appl. No.: 18/414,760

(22) Filed: Jan. 17, 2024

(65) Prior Publication Data

US 2024/0148163 A1 May 9, 2024

Related U.S. Application Data

(63) Continuation of application No. 17/552,689, filed on Dec. 16, 2021, now Pat. No. 11,903,493.

(30) Foreign Application Priority Data

Dec. 17, 2020 (CN) ..... 202011494598.6

(51) Int. Cl.
*A47D 13/10* (2006.01)
*A47D 9/00* (2006.01)
*A63G 9/16* (2006.01)

(52) U.S. Cl.
CPC ..... *A47D 13/105* (2013.01); *A47D 9/005* (2013.01); *A47D 9/016* (2022.08); *A47D 13/101* (2022.08)

(58) Field of Classification Search
CPC ... A63G 9/00; A63G 9/04; A63G 9/12; A63G 9/16; A47D 13/105; A47D 9/005; A47D 9/016; A47D 13/101
(Continued)

(56) References Cited

U.S. PATENT DOCUMENTS 5,203,540 A 4/1993 Lee
6,520,862 B1 * 2/2003 Armbruster ..... A47D 13/105 472/118
(Continued)

FOREIGN PATENT DOCUMENTS

CN 2376818 Y 5/2000
CN 2807946 Y 8/2006
(Continued)

OTHER PUBLICATIONS

First Office Action issued in Chinese Patent Application No. 2020114945986, mailed Oct. 28, 2023; 7 pgs.
(Continued)

*Primary Examiner* — Kien T Nguyen
(74) *Attorney, Agent, or Firm* — HAUPTMAN HAM, LLP

(57) ABSTRACT

A foldable swing frame is provided and includes a seat assembly, a lateral support, a joint assembly and a bottom leg assembly. The lateral support is located beside the seat assembly. The seat assembly is assembled with the lateral support. The joint assembly is installed on the lateral support. The bottom leg assembly is for standing the foldable swing frame. The bottom leg assembly is assembled with the joint assembly. The bottom leg assembly is pivotally connected to the lateral support by the joint assembly, and the bottom leg assembly is switchable between a folded position and an unfolded position relative to the lateral support by the joint assembly. One or more embodiments of the foldable swing frame can be folded compactly to reduce an occupied space of the foldable swing frame without detachment of the seat assembly for easy transportation and easy storage.

27 Claims, 9 Drawing Sheets

(58) Field of Classification Search
USPC ..... 472/118–125
See application file for complete search history.

(56) References Cited

U.S. PATENT DOCUMENTS

| | | | | |
|---|---|---|---|---|
| 6,645,080 | B1 * | 11/2003 | Greger | A47D 13/105 472/118 |
| 2004/0198512 | A1 | 10/2004 | Ransil et al. | |
| 2007/0049389 | A1 | 3/2007 | Paesang et al. | |
| 2007/0049390 | A1 | 3/2007 | Wu et al. | |
| 2013/0012329 | A1 | 1/2013 | Burns et al. | |
| 2013/0214573 | A1 | 8/2013 | Oren | |
| 2014/0366276 | A1 | 12/2014 | Chang et al. | |
| 2016/0157633 | A1 | 6/2016 | Aboukrat | |
| 2016/0309915 | A1 | 10/2016 | Burns et al. | |
| 2018/0146796 | A1 | 5/2018 | Logenecker | |
| 2019/0254442 | A1 | 8/2019 | Tuckey | |
| 2020/0138204 | A1 | 5/2020 | Zou | |

FOREIGN PATENT DOCUMENTS

| | | | |
|---|---|---|---|
| CN | 2891848 | Y | 4/2007 |
| CN | 201948519 | U | 8/2011 |
| CN | 102860712 | A | 1/2013 |
| CN | 103315565 | A | 9/2013 |
| CN | 107411430 | A | 12/2017 |
| CN | 207085301 | U | 3/2018 |
| CN | 108302115 | A | 7/2018 |
| CN | 109965600 | A | 7/2019 |
| CN | 209186064 | U | 8/2019 |
| CN | 110269433 | A | 9/2019 |
| CN | 209547590 | U | 10/2019 |
| CN | 113080653 | A | 7/2021 |
| CN | 214319099 | | 10/2021 |
| DE | 20 2013 100 752 | U1 | 6/2013 |
| DE | 20 2014 101 886 | U1 | 6/2014 |
| DE | 20 2015 106 586 | U1 | 3/2016 |
| DE | 10 2019 202 239 | A1 | 8/2019 |
| EP | 3181014 | A1 | 6/2017 |
| GB | 2428967 | A | 2/2007 |
| TW | M261077 | U | 4/2005 |

OTHER PUBLICATIONS

First Office Action issued in Taiwan Patent Application 110146838, mailed Apr. 25, 2022, 5 pgs.

* cited by examiner

FOLDABLE SWING FRAME

CROSS REFERENCE TO RELATED APPLICATIONS

This application is a continuation application of U.S. application Ser. No. 17/552,689, filed Dec. 16, 2021, which claims priority to the Chinese Patent Application No. 202011494598.6, filed on Dec. 17, 2020, the entire content of which is incorporated herein in its entirety.

FIELD

One or more embodiments of the present invention relates to a child product, and more specifically, to a foldable swing frame.

BACKGROUND

With increase of living standards of people, various child products are widely used in families. A swing frame is one of the most popular child products. In order to ensure a child's safety, the swing frame includes a base for allowing the swing frame to stand stably. However, the conventional swing frame is not foldable. Therefore, the swing frame occupies a larger space when not in use, which is inconvenient for transportation or storage. Furthermore, there is another conventional swing frame including a detachable seat for allowing a user to detach the seat to reduce an occupied space of the swing frame when the swing frame is not in use. However, a base of such swing frame is not foldable, and such swing frame still occupies a certain space when not in use. Therefore, the aforementioned problem has not been effectively solved.

SUMMARY

One or more embodiments of the present invention aims at providing a foldable swing frame capable of being folded compactly for solving one or more of the aforementioned problems in the prior art.

In order to achieve the aforementioned objective, one or more embodiments of the present invention discloses a foldable swing frame including a seat assembly, at least one lateral support, at least one joint assembly and at least one bottom leg assembly. The at least one lateral support is located beside the seat assembly. The seat assembly is assembled with the at least one lateral support. The at least one joint assembly is installed on the at least one lateral support. The at least one bottom leg assembly is for standing the foldable swing frame. The at least one bottom leg assembly is assembled with the at least one joint assembly. The at least one bottom leg assembly is pivotally connected to the at least one lateral support by the at least one joint assembly, and the at least one bottom leg assembly is switchable between a folded position and an unfolded position relative to the at least one lateral support by the at least one joint assembly.

In contrast to the prior art, in one or more embodiments of the present invention, the bottom leg assembly is switchable between the folded position and the unfolded position relative to the lateral support, and the first seat frame and the second seat frame are capable of pivotally folding or unfolding relative to the swing arm. Therefore, when the foldable swing frame is not in use, an occupied space of the foldable swing frame can be reduced effectively by switching the bottom leg assembly to the folded position and pivotally folding the first seat frame and the second seat frame relative to the swing arm, without detachment of the seat assembly. Therefore, the foldable swing frame has advantages of compact folding, easy transportation and easy storage.

These and other objectives of the present invention will no doubt become obvious to those of ordinary skill in the art after reading the following detailed description of the embodiments illustrated in the various figures and drawings.

DETAILED DESCRIPTION

In order to illustrate technical specifications and structural features as well as achieved purposes and effects of one or more embodiments of the present invention, relevant embodiments and figures are described as follows.

In the following detailed description of the embodiments, reference is made to the accompanying drawings which form a part hereof, and in which is shown by way of illustration specific embodiments in which the invention may be practiced. In this regard, directional terminology, such as "top", "bottom", "left", "right", "front", "back", etc., is used with reference to the orientation of the Figure(s) being described. The components of the present invention can be positioned in a number of different orientations. As such, the directional terminology is used for purposes of illustration and is in no way limiting. Accordingly, the drawings and descriptions will be regarded as illustrative in nature and not as restrictive. Also, if not specified, the term "connect" is intended to mean either an indirect or direct mechanical connection. Thus, if a first device is coupled to a second device, that connection may be through a direct mechanical connection, or through an indirect mechanical connection via other devices and connections.

Furthermore, "first," "second," and "third" in the preceding embodiments are configured to distinguish embodiments, but do not represent superiority or inferiority of all embodiments, i.e., "first embodiment" is intended to mean neither "representative embodiment" nor "preferred embodiment."

Figure 1:
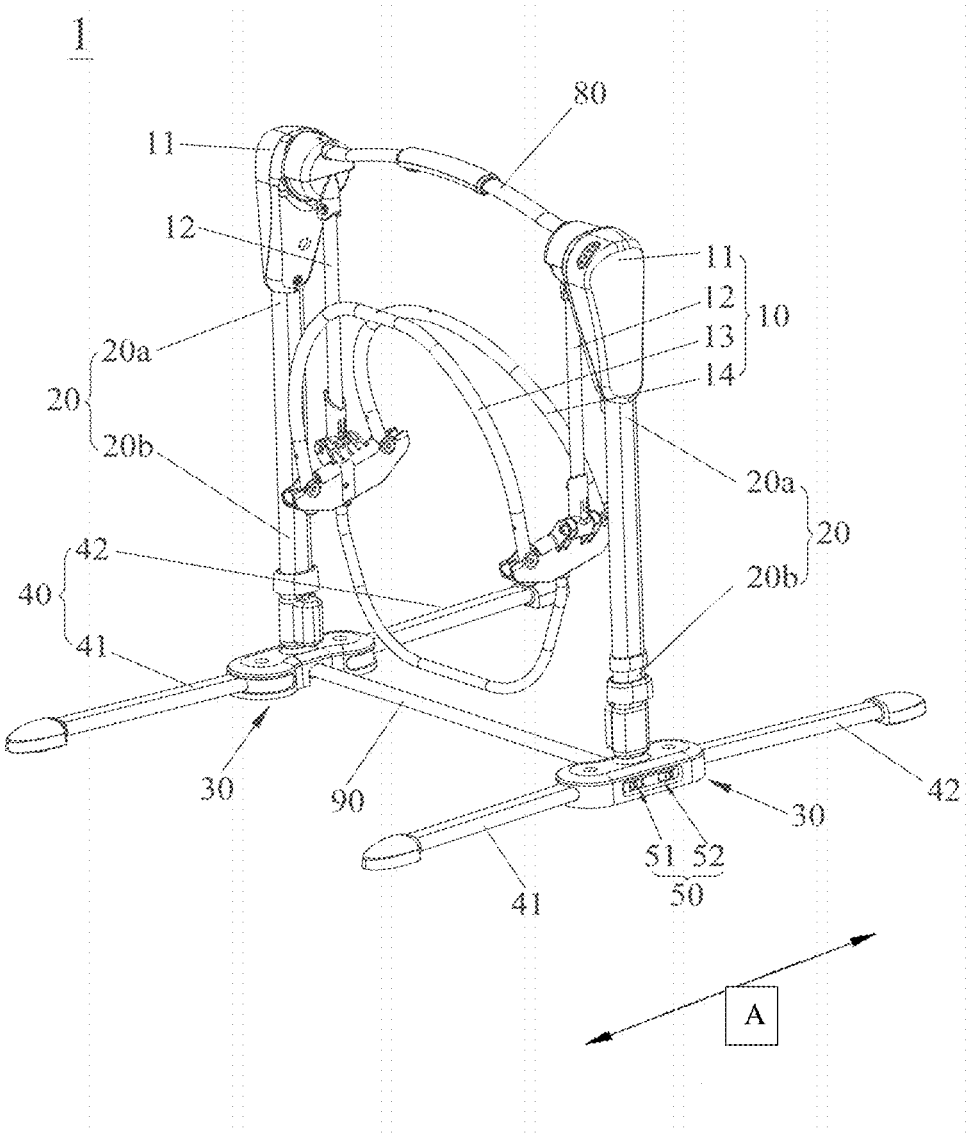
FIG. 1 and FIG. 2 are schematic diagrams of a foldable swing frame in different states according to a first embodiment of the present invention.
Figure 2:
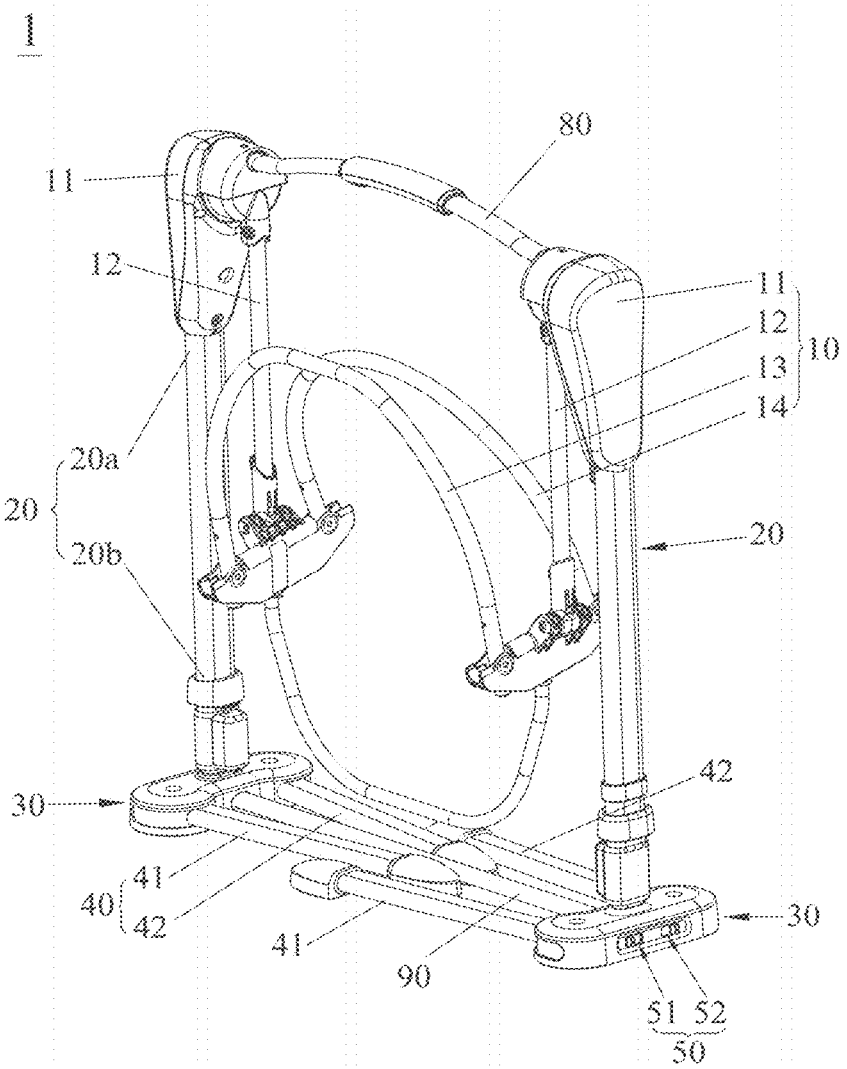

Please refer to FIG. 1 and FIG. 2. FIG. 1 and FIG. 2 are schematic diagrams of a foldable swing frame 1 in different states according to a first embodiment of the present invention. As shown in FIG. 1 and FIG. 2, the foldable swing frame 1 includes a seat assembly 10, two lateral supports 20, two joint assemblies 30 and two bottom leg assemblies 40.

The two lateral supports 20 are located beside the seat assembly 10. The seat assembly 10 is assembled with the two lateral supports 20. The two joint assemblies 30 are respectively installed on the two lateral supports 20. The two bottom leg assemblies 40 are respectively assembled with the two joint assemblies 30. Each of the bottom leg assemblies 40 is pivotally connected to the corresponding lateral support 20 and switchable between a folded position as shown in FIG. 2 and an unfolded position as shown in FIG. 1 relative to the corresponding lateral support 20 by the corresponding joint assembly 30.

In this embodiment, as shown in FIG. 1 and FIG. 2, the seat assembly 10 is hung by the two lateral supports 20 to allow a pivoting movement of the seat assembly 10 relative to the two lateral supports 20. Furthermore, each of the joint assemblies 40 and the seat assembly 10 are respectively installed on a bottom portion 20*b* and a top portion 20*a* of the corresponding lateral support 20, by way of a corresponding joint assembly 30, to make the structure reasonably compact. Besides, each of the bottom leg assemblies 40 is configured to pivot horizontally. In such a way, during a switching movement of each of the bottom leg assemblies 40 between the folded position as shown in FIG. 2 and the unfolded position as shown in FIG. 1, each of the bottom leg assemblies 40 pivots horizontally, so that each of the bottom leg assemblies can enable the foldable swing frame 1 to stand stably no matter when each of the bottom leg assemblies 40 is located at the unfolded position as shown in FIG. 1 or the folded position as shown in FIG. 2, which makes it easy to fold the foldable swing frame 1. However, the present invention is not limited to this embodiment.

Specifically, as shown in FIG. 1 and FIG. 2, the two lateral supports 20 are spaced from each other and respectively located at a left side and a right side of the foldable swing frame 1. The two joint assemblies 30 are spaced from each other and respectively located at the left side and the right side of the foldable swing frame 1. The two bottom leg assemblies 40 are spaced from each other and respectively located at the left side and the right side of the foldable swing frame 1. The seat assembly 10 is located between the two lateral supports 20, so that the hung seat assembly 10 can be supported by the two lateral supports 20 reliably. The two joint assemblies 30 and the two bottom leg assemblies 40 can balance the left side and the right side of the foldable swing frame 1, which prevents tilting or falling of the foldable swing frame 1 to ensure the foldable swing frame 1 to stably stand.

Understandably, the numbers of the lateral support, the joint assembly and the bottom leg assembly are not limited to this embodiment. For example, in another embodiment, the foldable swing frame can include only one lateral support, one joint assembly and one bottom leg assembly at one side or at a center.

Figure 3:
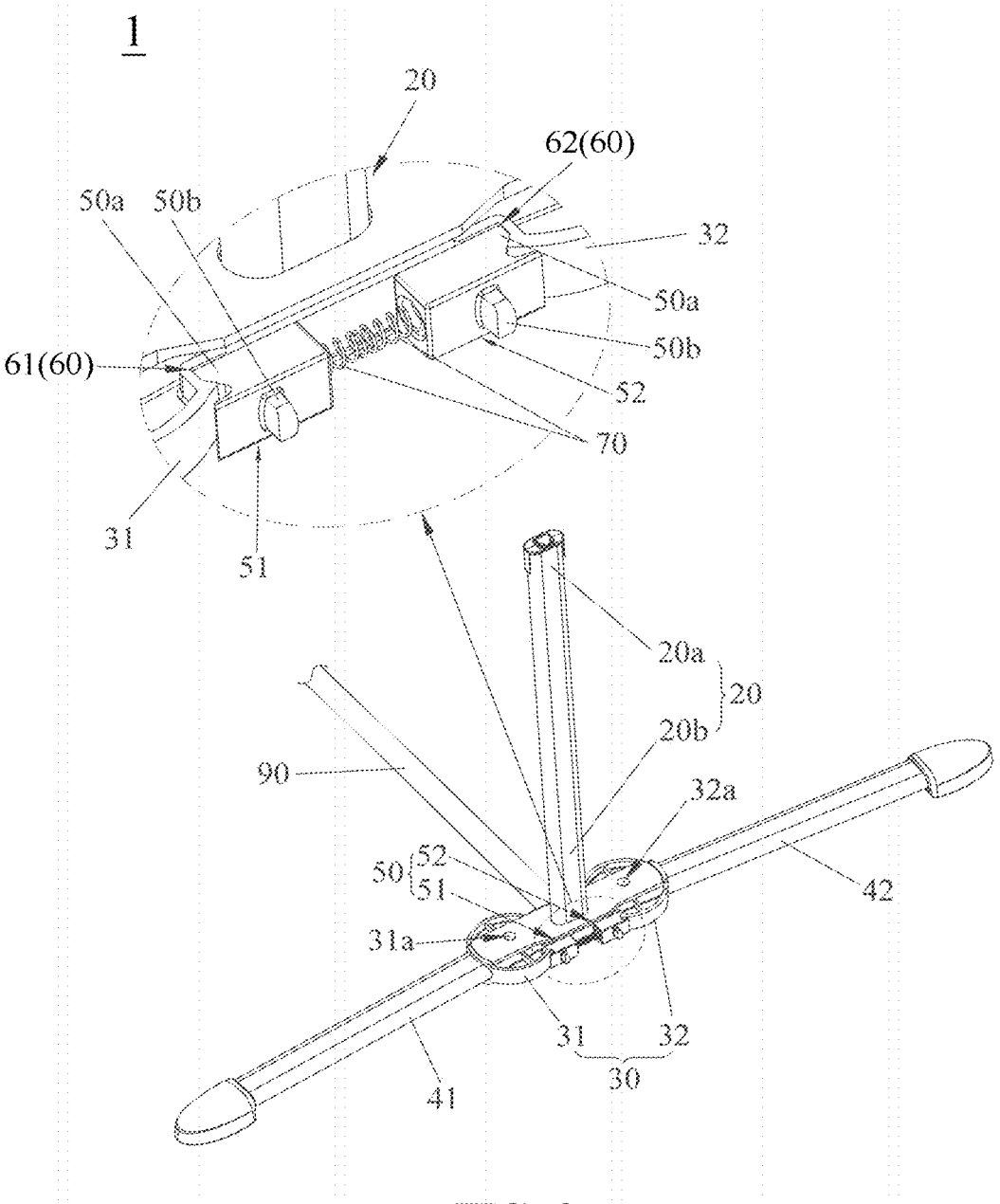
FIG. 3 is a partial diagram of the foldable swing frame according to the first embodiment of the present invention.
Figure 4:
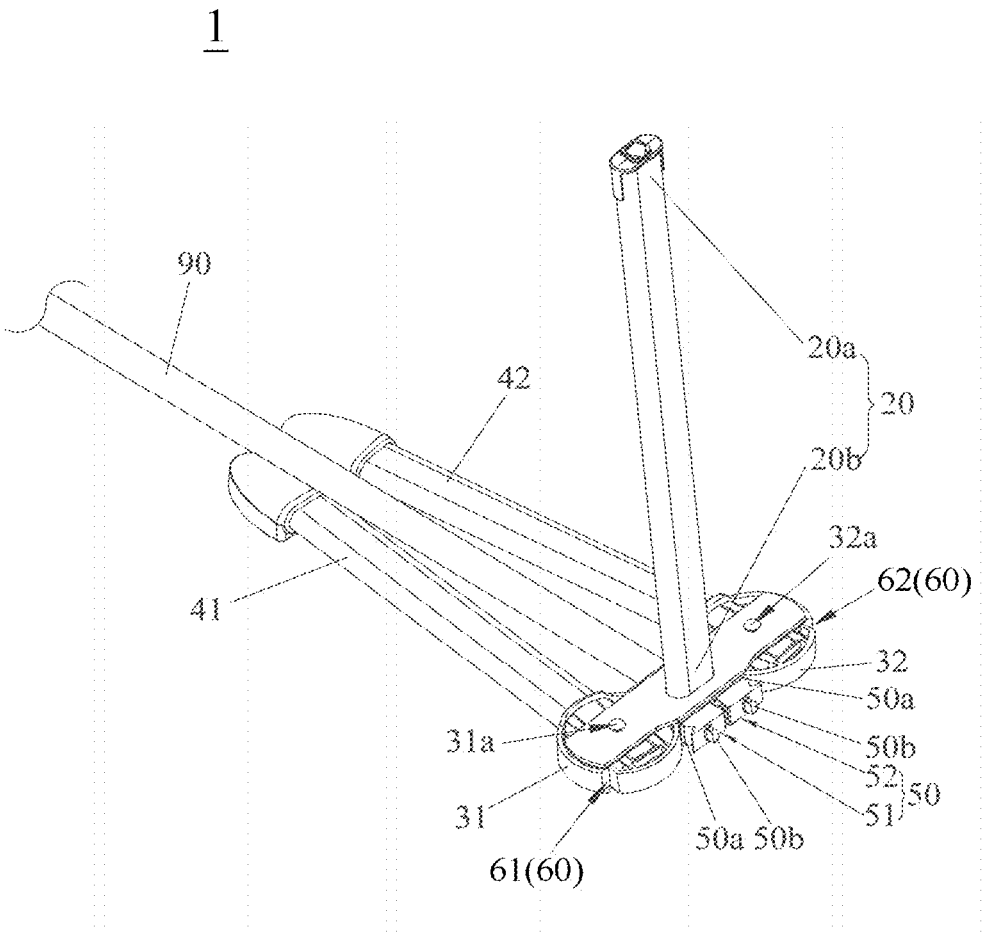
FIG. 4 is another partial diagram of the foldable swing frame according to the first embodiment of the present invention.

More specifically, please refer to FIG. 3 and FIG. 4. FIG. 3 is a partial diagram of the foldable swing frame 1 according to the first embodiment of the present invention. FIG. 4 is another partial diagram of the foldable swing frame 1 according to the first embodiment of the present invention. As shown in FIG. 3 and FIG. 4, the foldable swing frame 1 further includes a locking assembly 50 and a resilient recovering component 70. In at least one embodiment, the resilient recovering component 70 is a spring. The locking assembly 50 is movably installed on the corresponding lateral support 20 and switchable between a locking position as shown in FIG. 3 and an unlocking position as shown in FIG. 4. When the locking assembly 50 moves to the locking position as shown in FIG. 3, the locking assembly 50 prevents the corresponding bottom leg assembly 40 from switching from the unfolded position as shown in FIG. 1 to the folded position as shown in FIG. 2. The resilient recovering component 70 abuts against the locking assembly 50 to drive the locking assembly 50 to move to the locking position as shown in FIG. 3, so that the locking assembly 50 can be driven by the resilient recovering component 70 to automatically lock the corresponding bottom leg assembly 40 at the unfolded position as shown in FIG. 1, which is convenient in use. Furthermore, as shown in FIG. 3 and FIG. 4, a locked structure 60 is formed on the joint assembly 30 corresponding to the locking assembly 50 and for cooperating with the locking assembly 50. When the locking assembly 50 moves to the locking position as shown in FIG. 3, the locking assembly 50 engages with the locked structure 60.

In this embodiment, the locked structure 60 can include a hole structure. However, the structure of the locked structure 60 is not limited to this embodiment.

Understandably, the structure of the foldable swing frame is not limited to this embodiment. The structure depends on practical demands. For example, in another embodiment, the resilient recovering component can be omitted, and a user has to operate the locking assembly manually to switch the locking assembly between the locking position and the unlocking position. Alternatively, in another embodiment, the locking assembly can be disposed on the lateral support, and the locked structure can be formed on the bottom leg assembly. Alternatively, in another embodiment, the locking assembly can be disposed on the joint assembly, and the locked structure can be formed on the lateral support. Alternatively, in another embodiment, the foldable swing frame can include two locking assemblies respectively installed on the two lateral supports, two resilient recovering components respectively abutting against the two locking assemblies, and two locked structures respectively formed on the two joint assemblies.

As shown in FIG. 3 and FIG. 4, in order to achieve convenient operation of the locking assembly 50, the locking assembly 50 is configured to slide horizontally. Specifically, the locking assembly 50 includes two locking portions 50*a* and two operating portions 50*b*. Each of the locking portions 50*a* is for engaging with the locked structure 60. Each of the operating portions 50*b* is connected to the corresponding locking portion 50*a*. The user can operate the two operating portions 50*b* to drive the locking assembly 50 to switch between the locking position and the unlocking position.

In this embodiment, the locking assembly 50 can include a sliding button slidable along a front-rear direction of the foldable swing frame 1, i.e., an arrow direction A shown in FIG. 1, and located at an outer side of the corresponding lateral support 20. However, the present invention is not limited to this embodiment.

As shown in FIG. 1 to FIG. 4, in order to allow the foldable swing frame 1 to stand stably by the two bottom leg assemblies 40, each of the bottom leg assemblies 40 includes a first bottom leg 41 and a second bottom leg 42. Each of the joint assemblies 30 includes a first joint component 31 and a second joint component 32. Each of the first joint components 31 is pivotally connected to the corresponding lateral support 20. Each of the first bottom legs 41 is installed on the corresponding first joint component 31. Each of the second joint components 31 is pivotally connected to the corresponding lateral support 20. Each of the second bottom legs 42 is installed on the corresponding second joint component 32.

In this embodiment, as shown in FIG. 3 and FIG. 4, a pivotal connection of each of the first joint components 31 and the corresponding lateral support 20 does not coincide with a pivotal connection of each of the second joint component 32 and the corresponding lateral support 20. Furthermore, the pivotal connection of each of the first joint components 31 and the corresponding lateral support 20 and the pivotal connection of each of the second joint component 32 and the corresponding lateral support 20 can be arranged along the front-rear direction A of the foldable swing frame 1, so that the foldable swing frame 1 can stand stably even when each of the bottom leg assemblies 40 is located at the folded position as shown in FIG. 2. However, the present invention is not limited to this embodiment.

As shown in FIG. 1 to FIG. 4, each of the first joint components 31 and each of the second joint components 32 can pivotally fold or unfold relative to the corresponding lateral support 20. Each of the first joint components 31 and each of the second joint components 32 can respectively drive the corresponding first bottom leg 41 and the corresponding second bottom leg 42 to move away from each other when each of the bottom leg assemblies 40 switches to the unfolded position as shown in FIG. 1. Each of the first joint components 31 and each of the second joint components 32 can respectively drive the corresponding first bottom leg 41 and the corresponding second bottom leg 42 to move toward each other when each of the bottom leg assemblies 40 switches to the folded position as shown in FIG. 2. In other words, each of the first bottom legs 41 is movable together with the corresponding first joint component 31, and each of the second bottom legs 42 is movable together with the corresponding second joint component 32.

Specifically, in this embodiment, each of the first joint components 31 and each of the second joint components 32 are configured to pivot horizontally, so that each of the first joint components 31 and each of the second joint components 32 can respectively drive the corresponding first bottom leg 41 and the corresponding second bottom leg 42 to pivot horizontally to achieve the smooth switching movement of each of the bottom leg assemblies 40. However, the present invention is not limited to this embodiment.

More specifically, the locked structure 60 includes a first locked portion 61 formed on the first joint component 31 corresponding to the locking assembly 50 and a second locked portion 62 formed on the second joint component 32 corresponding to the locking assembly 50. The locking assembly 50 includes a first locking component 51 and a second locking component 52. The first locking component 51 and the second locking component 52 are slidably disposed on the corresponding lateral support 20. The first locking component 51 and the second locking component 52 can be two sliding buttons slidably disposed on the corresponding lateral support 20. The first locked portion 61 and the second locked portion 62 can be two hole structures respectively formed on the corresponding first joint component 31 and the corresponding second joint component 32. The two locking portions 50*a* are respectively formed on the first locking component 51 and the second locking component 52. The two operating portions 50*b* are respectively formed on the first locking component 51 and the second locking component 52. The first locking component 51 is for engaging with the first locked portion 61 for locking the corresponding first joint component 31. The second locking component 52 is for engaging with the second locked portion 62 for locking the corresponding second joint component 32.

As shown in FIG. 3 and FIG. 4, the first locking component 51 and the second locking component 52 are disposed in a back-to-back arrangement and slidable toward or away from each other. The first locking component 51 and the second locking component 52 respectively disengage from the first locked portion 61 and the second locked portion 62 for unlocking the corresponding first joint component and the corresponding second joint component during a process that the first locking component 51 and the second locking component 52 slide toward each other.

Besides, as shown in FIG. 3 and FIG. 4, the resilient recovering component 70 is abutted between the first locking component 51 and the second locking component 52 to make the structure more reasonably compact.

Understandably, the structure of the foldable swing frame is not limited to this embodiment. For example, in another embodiment, the foldable swing frame can include two resilient recovering components respectively disposed between the first locking component and the corresponding lateral support and between the second locking component and the corresponding lateral support.

As shown in FIG. 1 to FIG. 4, the foldable swing frame 1 further includes a top transverse rod 80 and a bottom transverse rod 90. The top transverse rod 80 is located above the seat assembly 10. The bottom transverse rod 90 is located beneath the seat assembly 10. Two ends of the top transverse rod 80 are respectively installed on the two lateral supports 20. The top transverse rod 80 is for the user to hold to make it easy to carry the foldable swing frame 1. Two ends of the bottom transverse rod 90 are respectively installed on the two lateral supports 20. The bottom transverse rod 90 is for stabilizing the structure of the foldable swing frame 1.

In this embodiment, when each of the bottom leg assemblies 40 switches to the folded position as shown in FIG. 2, each of the bottom leg assemblies 40 moves close to the bottom transverse rod 90, so that the foldable swing frame 1 occupies less space. Specifically, each of the bottom leg assemblies 40 includes the first bottom leg 41 and the second bottom leg 42. Therefore, when each of the bottom leg assemblies 40 switches to the folded position as shown in FIG. 2, the first bottom leg 41 and the second bottom leg 42 of each of the bottom leg assemblies 40 move close to the bottom transverse rod 90, so that the bottom transverse rod 90 is clamped between the first bottom leg 41 and the second bottom leg 42 of each of the bottom leg assemblies 40 along the front-rear direction of the foldable swing frame 1. Because there is no gap or a smaller gap between each of the bottom leg assemblies 40 and the bottom transverse rod 90, the foldable swing frame 1 occupies less space.

Understandably, the structure of the foldable swing frame is not limited to this embodiment. For example, in another embodiment, each of the bottom leg assemblies does not move close to the bottom transverse rod when each of the bottom leg assemblies switches to the folded position.

As shown in FIG. 1 and FIG. 2, in order to ensure the seat assembly 10 pivots smoothly, the seat assembly 10 includes two pivoting devices 11 and two swing arms 12. The two pivoting devices 11 are spaced from each other and respectively located at the left side and the right side of the foldable swing frame 1. The two swing arms 12 are spaced from each other and respectively located at the left side and the right side of the foldable swing frame 1. Each of the pivoting devices 11 is assembled with the top portion 20*a* of the corresponding lateral support 20. Each of the swing arms 12 is assembled with the corresponding pivoting device 11. Each of the swing arms 12 is pivotally connected to the top portion 20*a* of the corresponding lateral support 20 by the corresponding pivoting device 11.

Understandably, the structure of the foldable swing arm is not limited to this embodiment. For example, in another embodiment, the seat assembly can include only one pivoting device at a center or any other position of the top transverse rod, and one swing arm assembled with the pivoting device.

Furthermore, as shown in FIG. 1 and FIG. 2, the seat assembly 10 further includes a first seat frame 13 and a second seat frame 14. Two ends of the first seat frame 13 are respectively pivotally connected to the two swing arms 12. Two ends of the second seat frame 14 are respectively pivotally connected to the two swing arms 12. The top portion of each of the two swing arms 12 is assembled with the corresponding pivoting device 11. The aforementioned configurations make the structure of the seat assembly 10 more reasonably compact. The first seat frame 13 and the second seat frame 14 can pivotally move toward the two swing arms 12 to fold relative to the two swing arms 12 or to pivotally move away from the two swing arms 12 to unfold relative to the two swing arms 12. Specifically, the first seat frame 13 and the second seat frame 14 pivot upwardly or downwardly to move toward each other to fold relative to the two swing arms 12.

As shown in FIG. 1 and FIG. 2, the swing arm 12, the first seat frame 13 and the second seat frame 14 can be U-shaped structures for providing an accommodating space for accommodating a child carrier or a child.

Understandably, the structure of the foldable swing frame is not limited to this embodiment. For example, in another embodiment, the swing arm, the first seat frame and the second seat frame can be integrally formed together. Alternatively, in another embodiment, the first seat frame and the second seat frame can be integrally formed together.

Figure 5:
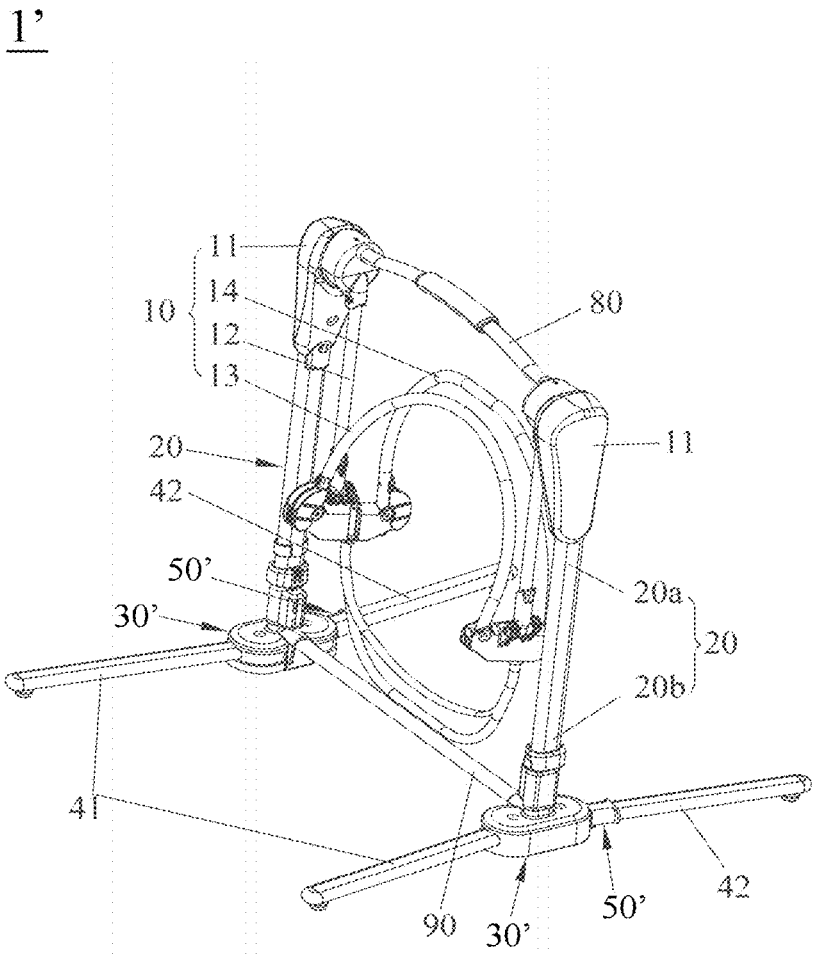
FIG. 5 is a schematic diagram of the foldable swing frame according to a second embodiment of the present invention.
Figure 6:
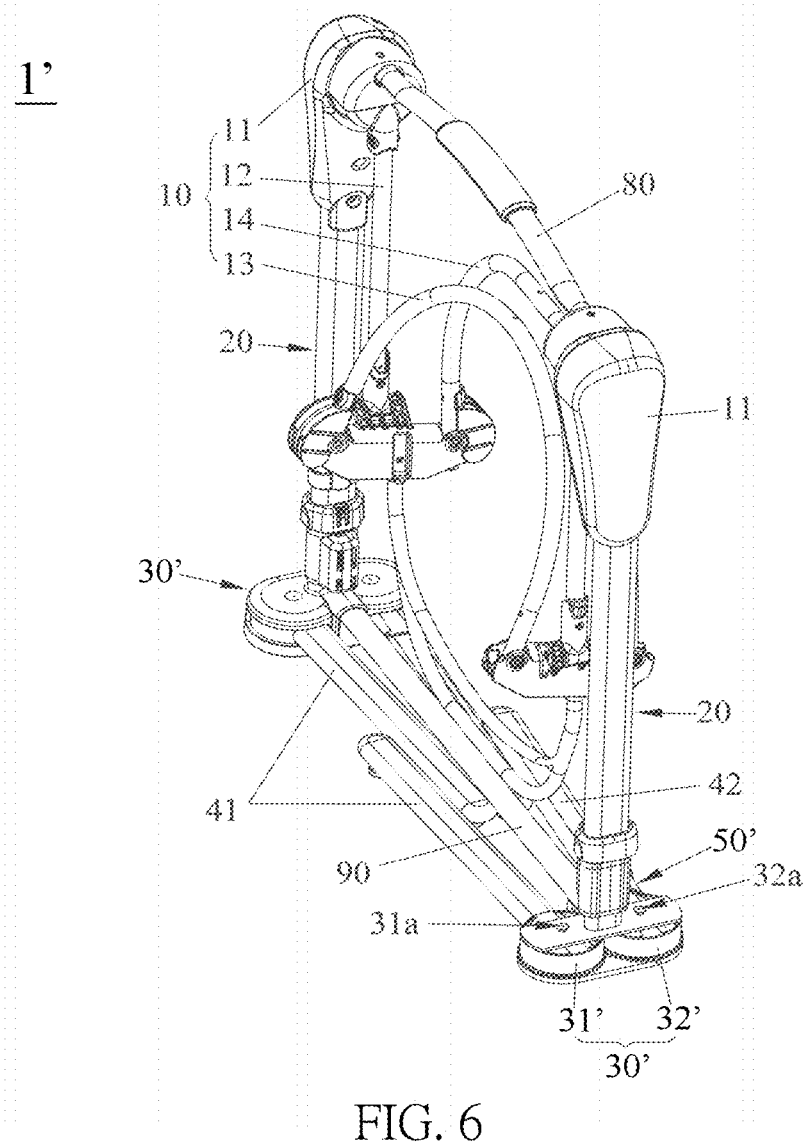
FIG. 6 is a partial diagram of the foldable swing frame in another state according to the second embodiment of the present invention.
Figure 7:
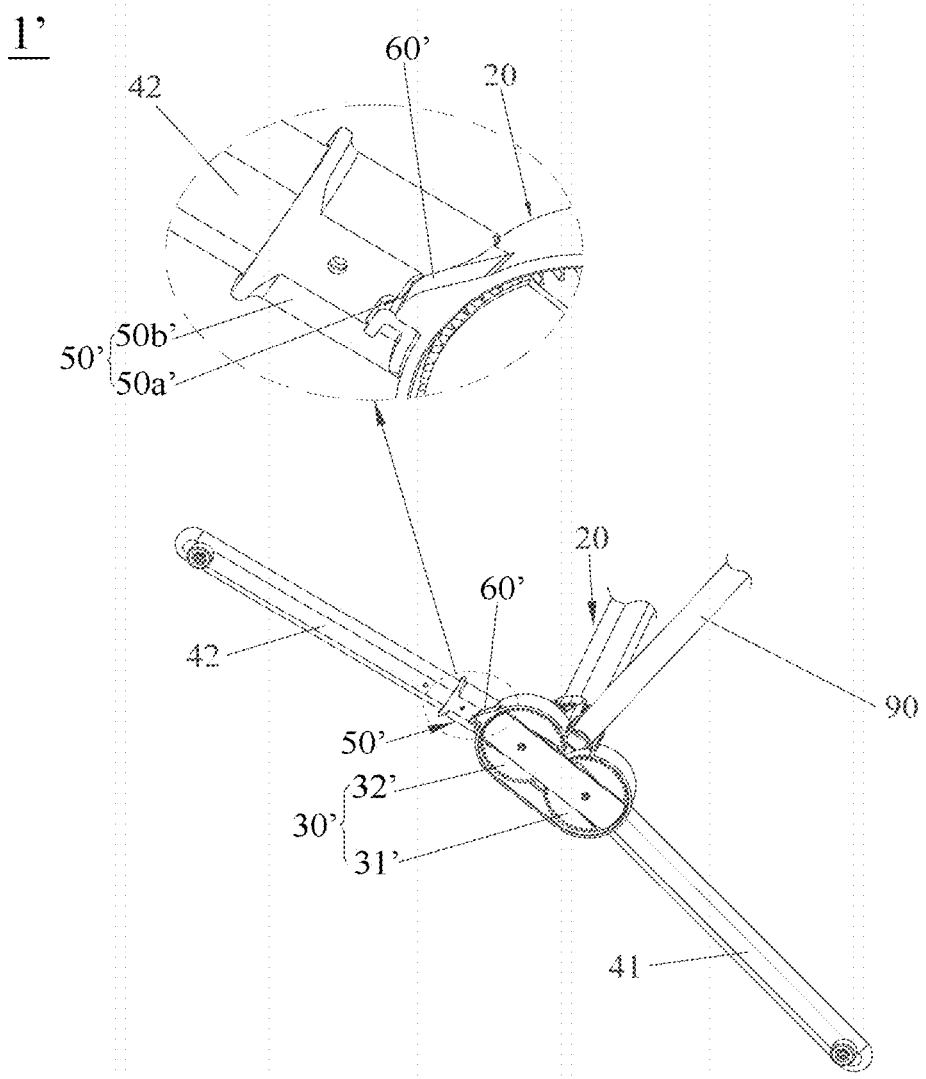
FIG. 7 and FIG. 8 are partial enlarged diagrams of the foldable swing frame in different states according to the second embodiment of the present invention.
Figure 8:
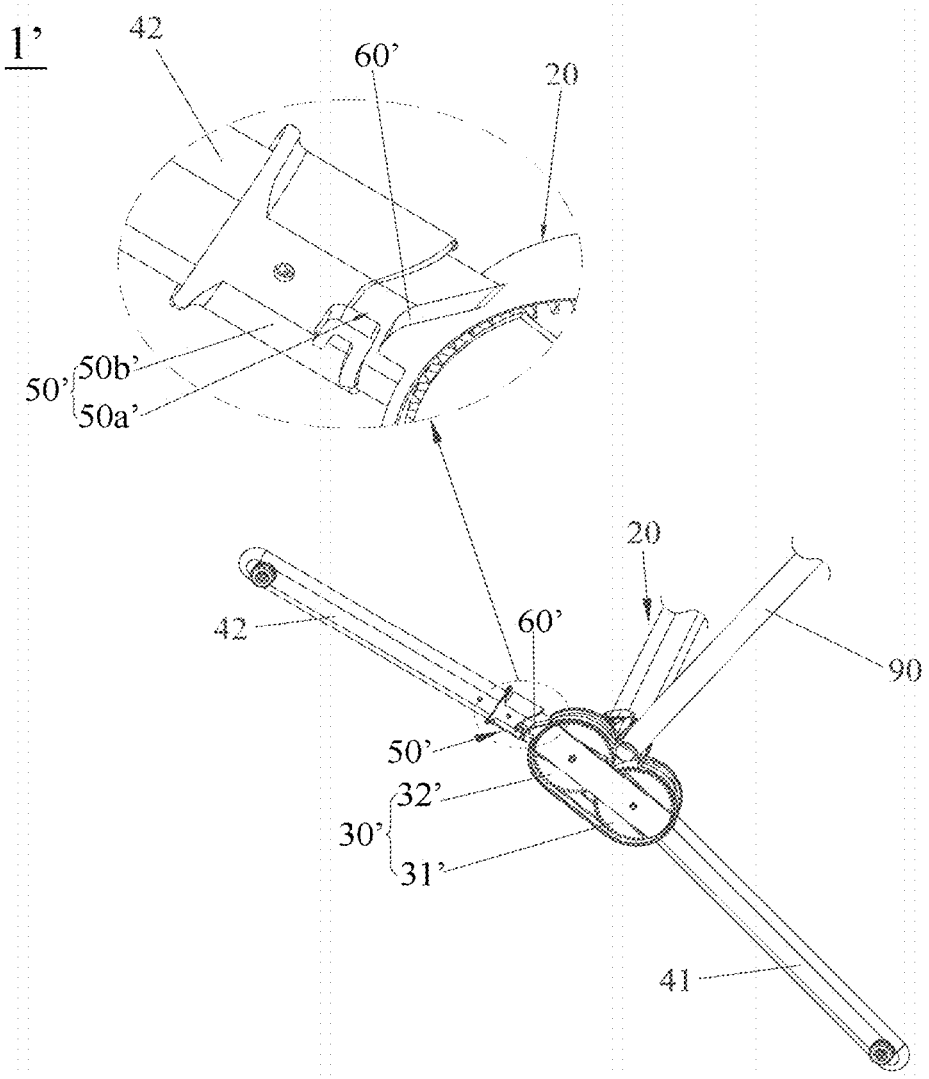

Please refer to FIG. 5 to FIG. 8. FIG. 5 is a schematic diagram of the foldable swing frame 1' according to a second embodiment of the present invention. FIG. 6 is a partial diagram of the foldable swing frame 1' in another state according to the second embodiment of the present invention. FIG. 7 and FIG. 8 are partial enlarged diagrams of the foldable swing frame 1' in different states according to the second embodiment of the present invention. As shown in FIG. 5 to FIG. 8, the foldable swing frame 1' of the second embodiment is similar to the foldable swing frame 1 of the first embodiment. The differences between the foldable swing frame 1' of the second embodiment and the foldable swing frame 1 of the first embodiment are described as follows.

In the second embodiment, a first joint component 31' and a second joint component 32' of a joint assembly 30' of the foldable swing frame 1' can be two synchromesh gear components rotatably engaged with each other. Therefore, the user only has to pivotally fold or unfold one of the first bottom leg 41 and the second bottom leg 42, and the other one of the first bottom leg 41 and the second bottom leg 42 can be driven to pivotally fold or unfold, which is convenient in use. In the first embodiment, the first joint component 31 and the second joint component 32 cannot be driven synchronously by each other, and therefore, the user has to pivotally fold or unfold both of the first bottom leg 41 and the second bottom leg 42.

In the second embodiment, the foldable swing frame 1' includes two locking assemblies 50'. Each of the locking assemblies 50' is movably installed on the corresponding bottom leg assembly 40. Specifically, as shown in FIG. 7 and FIG. 8, the locking assembly 50' is slidably disposed on the corresponding second bottom leg 42, and a locked structure 60' is formed on the corresponding lateral support 20. Furthermore, each of the locking assemblies 50' includes a sliding sleeve slidably sleeved on the corresponding second bottom leg 42. Understandably, in another embodiment, the locking assembly can include one sliding sleeve slidably sleeved on the first bottom leg, or two sliding sleeves respectively slidably sleeved on the first bottom leg and the second bottom leg. In the first embodiment, the locking assembly 50 is movably installed on the corresponding lateral support 20 and includes the first locking component 51 and the second locking component 52. The locked structure 60 includes the first locked portion 61 and the second locked portion 62 respectively formed on the first joint component 31 and the second joint component 32. The first locking component 51 and the second locking component 52 are the two sliding buttons.

In the second embodiment, the locked structure 60' includes a protruding structure. A locking portion 50*a'* of the locking assembly 50', which is connected to an operating portion 50*b'* of the locking assembly 50', includes a recess structure for cooperating with the protruding structure of the locked structure 60'. In the first embodiment, the locked structure 60 includes the hole structure.

Other structures of the second embodiment are identical to ones of the first embodiment and have similar variations described above. Detailed description is omitted herein for simplicity.

Figure 9:
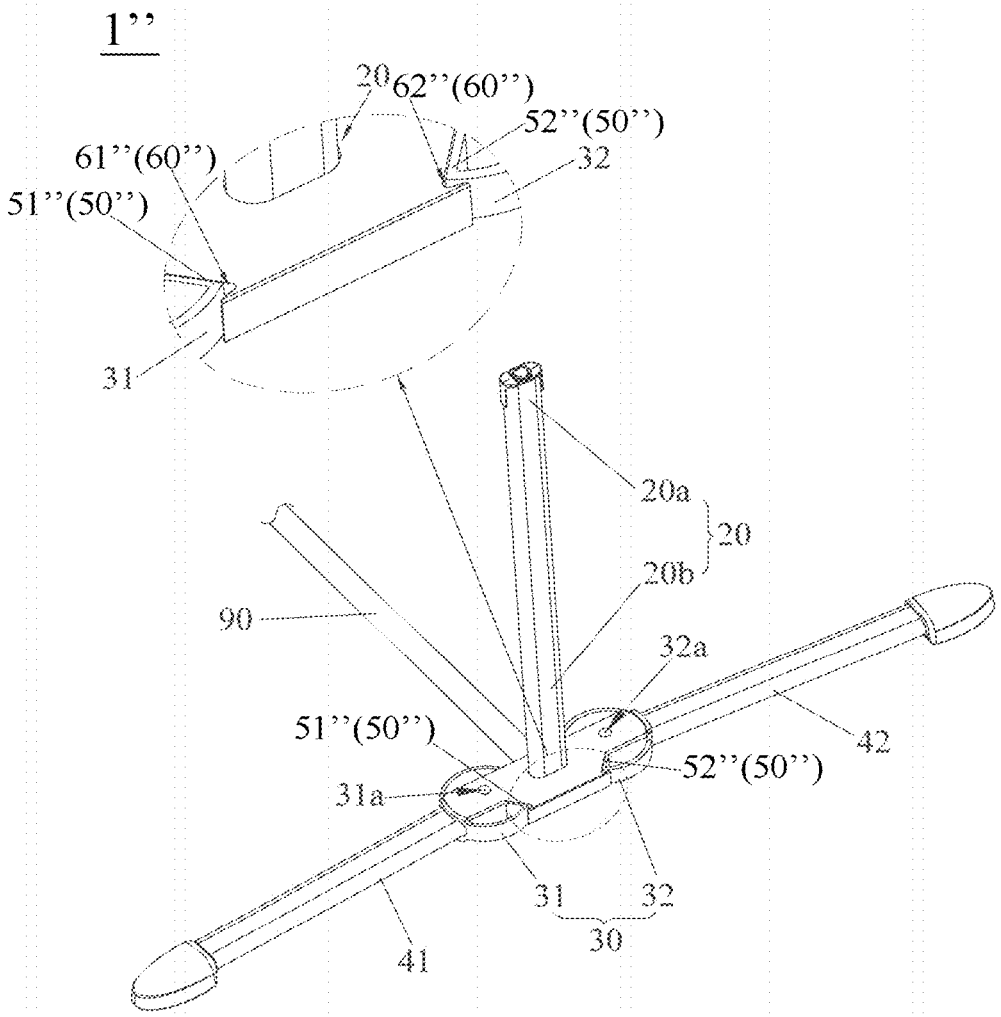
FIG. 9 is a partial enlarged diagram of a foldable swing frame according to a third embodiment of the present invention.

Please refer to FIG. 9. FIG. 9 is a partial enlarged diagram of a foldable swing frame 1" according to a third embodiment of the present invention. As shown in FIG. 9, the foldable swing frame 1" of the third embodiment is similar to the foldable swing frame 1 of the first embodiment. The difference between the foldable swing frame 1" of the third embodiment and the foldable swing frame 1 of the first embodiment is described as follows.

As shown in FIG. 9, in the third embodiment, the foldable swing frame 1" includes a locking assembly 50" and a locked structure 60" but does not include the resilient recovering component. A first locking component 51" of the locking assembly 50" is disposed on the corresponding first joint component 31 and integrally formed with the corresponding first joint component 31. A second locking component 52" of the locking assembly 50" is disposed on the corresponding second joint component 32 and integrally formed with the corresponding second joint component 32. The locked structure 60" includes a first locked portion 61" and a second locked portion 62". The first locked portion 61" and the second locked portion 62" are formed on the corresponding lateral support 20 and for respectively cooperating with the first locking component 51" and the second locking component 52". The locking assembly 50" switches between the locking position and the unlocking position in a resiliently deforming manner. The first locking component 51" and the second locking component 52" respectively engage with the first locked portion 61" and the second locked portion 62" when the locking assembly 50" switches to the locking position.

In the first embodiment, the locking assembly 50 switches between the locking position and the unlocking position in a moving manner. The first locking component 51 and the second locking component 52 are slidably disposed on the corresponding lateral support 20. The first locked portion 61 and the second locked portion 62 of the locked structure 60 are respectively formed on the corresponding first joint component 31 and the corresponding second joint component 32. The resilient recovering component 70 is disposed between the first locking component 51 and the second locking component 52.

Other structures of the third embodiment are identical to ones of the first embodiment and have similar variations described above. Detailed description is omitted herein for simplicity.

In contrast to the prior art, in one or more embodiments of the present invention, the bottom leg assembly is switchable between the folded position and the unfolded position relative to the lateral support, and the first seat frame and the second seat frame are capable of pivotally folding or unfolding relative to the swing arm. Therefore, when the foldable swing frame is not in use, an occupied space of the foldable swing frame can be reduced effectively by switching the bottom leg assembly to the folded position and pivotally folding the first seat frame and the second seat frame relative to the swing arm, without detachment of the seat assembly. Therefore, the foldable swing frame has advantages of compact folding, easy transportation and easy storage.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A foldable swing frame comprising:

a seat assembly;

at least one lateral support located beside the seat assembly, the seat assembly being assembled with the at least one lateral support;

at least one joint assembly installed on the at least one lateral support;

at least one bottom leg assembly for standing the foldable swing frame, the at least one bottom leg assembly being assembled with the at least one joint assembly, the at least one bottom leg assembly being pivotally connected to the at least one lateral support by the at least one joint assembly, and the at least one bottom leg assembly being switchable between a folded position and an unfolded position relative to the at least one lateral support by the at least one joint assembly; and a top transverse rod, wherein the at least one lateral support includes two lateral supports spaced from each other, and two ends of the top transverse rod are respectively installed on the two lateral supports.

2. The foldable swing frame of claim 1, wherein the seat assembly is hung by the at least one lateral support.

3. The foldable swing frame of claim 1, wherein the at least one bottom leg assembly stands the foldable swing frame in response to the at least one bottom leg assembly being in the unfolded position.

4. The foldable swing frame of claim 1, wherein the at least one bottom leg assembly stands the foldable swing frame in response to the at least one bottom leg assembly being in the folded position.

5. The foldable swing frame of claim 1, wherein the at least one joint assembly is installed on a bottom portion of the at least one lateral support, the seat assembly is assembled with a top portion of the at least one lateral support, and the at least one bottom leg assembly pivots horizontally during a switching movement of the at least one bottom leg assembly between the folded position and the unfolded position.

6. The foldable swing frame of claim 1, further comprising at least one locking assembly installed on one of the at least one lateral support, the at least one joint assembly and the at least one bottom leg assembly and being switchable between a locking position and a unlocking position, and the at least one locking assembly preventing the at least one bottom leg assembly from switching from the unfolded position to the folded position in response to the at least one locking assembly being located at the locking position.

7. The foldable swing frame of claim 6, wherein the at least one locking assembly switches between the locking position and the unlocking position in a moving manner or in a resiliently deforming manner.

8. The foldable swing frame of claim 7, wherein at least one locked structure is formed on another one of the at least one lateral support, the at least one joint assembly and the at least one bottom leg assembly, and the at least one locking assembly engages with the at least one locked structure in response to the at least one locking assembly being located at the locking position.

9. The foldable swing frame of claim 8, further comprising at least one resilient recovering component abutting against the at least one locking assembly for driving the at least one locking assembly to move to the locking position.

10. The foldable swing frame of claim 8, wherein the at least one locked structure comprises a hole structure, and the at least one locking assembly is slidable horizontally.

11. The foldable swing frame of claim 8, wherein the at least one locking assembly comprises:

a locking portion for engaging with the at least one locked structure; and an operating portion connected to the locking portion, the at least one locking assembly being drivable by operation of the operating portion to switch between the locking position and the unlocking position.

12. The foldable swing frame of claim 11, wherein the at least one locking assembly comprises a sliding sleeve slidably sleeved on the at least one bottom leg assembly or a sliding button slidably disposed on the at least one lateral support.

13. The foldable swing frame of claim 1, wherein the at least one joint assembly comprises two joint assemblies spaced from each other, the at least one bottom leg assembly comprises two bottom leg assemblies spaced from each other, and the seat assembly is located between the two lateral supports.

14. The foldable swing frame of claim 13, further comprising a bottom transverse rod, two ends of the bottom transverse rod being respectively installed on the two lateral supports.

15. The foldable swing frame of claim 13, wherein the seat assembly comprises:

at least one pivoting device assembled with a top portion of the at least one lateral support; and at least one swing arm assembled with the at least one pivoting device, and the at least one swing arm being pivotally connected to the at least one lateral support by the at least one pivoting device.

16. The foldable swing frame of claim 15, wherein the seat assembly further comprises:

a first seat frame pivotally connected to the at least one swing arm; and a second seat frame pivotally connected to the at least one swing arm, the first seat frame and the second seat frame being configured to pivotally move toward the at least one swing arm to fold relative to the at least one swing arm or to pivotally move away from the at least one swing arm to unfold relative to the at least one swing arm.

17. The foldable swing frame of claim 16, wherein the first seat frame and the second seat frame pivot upwardly or downwardly to move toward each other to fold relative to the at least one swing arm.

18. The foldable swing frame of claim 15, wherein the at least one pivoting device comprises two pivoting devices spaced from each other, and the two pivoting devices are respectively assembled with the two lateral supports.

19. The foldable swing frame of claim 18, wherein the at least one swing arm comprises two swing arms spaced from each other, two ends of the first seat frame are respectively pivotally connected to the two swing arms, two ends of the second seat frame are respectively pivotally connected to the two swing arms, and top portions of the two swing arms are respectively assembled with the two pivoting devices.

20. The foldable swing frame of claim 8, wherein the at least one joint assembly comprises a first joint component and a second joint component, the at least one bottom leg assembly comprises a first bottom leg and a second bottom leg, the first joint component is pivotally connected to the at least one lateral support, the first bottom leg is installed on the first joint component, the second joint component is pivotally connected to the at least one lateral support, the second bottom leg is installed on the second joint component, the first joint component and the second joint component are pivotable, the first joint component and the second joint component respectively drive the first bottom leg and the second bottom leg to move toward each other in response to the at least one bottom leg assembly switching to the folded position, and the first joint component and the second joint component respectively drive the first bottom leg and the second bottom leg to move away from each other in response to the at least one bottom leg assembly switching to the unfolded position.

21. The foldable swing frame of claim 20, wherein a pivotal connection of the first joint component and the at least one lateral support does not coincide with a pivotal connection of the second joint component and the at least one lateral support.

22. The foldable swing frame of claim 20, wherein the first joint component and the second joint component are configured to pivot horizontally to respectively drive the first bottom leg and the second bottom leg to pivot horizontally.

23. The foldable swing frame of claim 20, wherein the at least one locked structure comprises a first locked portion formed on the first joint component and a second locked portion formed on the second joint component, and the at least one locking assembly comprises:

a first locking component slidably disposed on the at least one lateral support for engaging with the first locked portion; and a second locking component slidably disposed on the at least one lateral support and for engaging with the second locked portion.

24. The foldable swing frame of claim 23, wherein the first locking component and the second locking component are disposed in a back-to-back arrangement and slidable toward or away from each other, and the first locking component and the second locking component respectively disengage from the first locked portion and the second locked portion during a process that the first locking component and the second locking component slide toward each other.

25. The foldable swing frame of claim 20, wherein the at least one locking assembly comprises a first locking component installed on the first joint component and a second locking component installed on the second joint component, and the at least one locked structure comprises:

a first locked portion formed on the at least one lateral support and for engaging with the first locking component; and a second locked portion formed on the at least one lateral support and for engaging with the second locking component.

26. The foldable swing frame of claim 20, wherein the at least one locking assembly is slidably disposed on at least one of the first bottom leg and the second bottom leg, and the at least one locked structure is formed on the at least one lateral support.

27. The foldable swing frame of claim 26, wherein the first joint component and the second joint component are two synchromesh gear components rotatably engaged with each other.

* * * * *